US006209619B1

(12) United States Patent
Mörwald et al.

(10) Patent No.: US 6,209,619 B1
(45) Date of Patent: Apr. 3, 2001

(54) BILLET-GUIDING SYSTEM FOR A CONTINUOUS CASTING PLANT

(75) Inventors: Karl Mörwald, St. Florian; Helmut Fitzel, Ennsdorf; Kurt Engel; Horst Fürhofer, both of St. Florian; Rudolf Scheidl, Erlauf; Reinhard Brandstetter, Asten, all of (AT)

(73) Assignee: Voest-Alpine Industrieanlagenbau GmbH, Linz (AT)

( * ) Notice: Subject to any disclaimer, the term of this patent is extended or adjusted under 35 U.S.C. 154(b) by 0 days.

(21) Appl. No.: 09/180,357

(22) PCT Filed: May 7, 1997

(86) PCT No.: PCT/AT97/00089

§ 371 Date: Nov. 5, 1998

§ 102(e) Date: Nov. 5, 1998

(87) PCT Pub. No.: WO97/41984

PCT Pub. Date: Nov. 13, 1997

(51) Int. Cl.[7] ..... B22D 11/20

(52) U.S. Cl. ..... 164/454; 164/442; 164/484; 164/413

(58) Field of Search ..... 164/447, 448, 164/441, 442, 484, 154.2, 413, 454

(56) References Cited

U.S. PATENT DOCUMENTS

| | | | | |
|---|---|---|---|---|
| 3,812,900 | | 5/1974 | Bollig et al. | 164/76 |
| 3,831,661 | | 8/1974 | Anderton et al. | 164/282 |
| 5,490,555 | * | 2/1996 | Korpela | 164/454 |

FOREIGN PATENT DOCUMENTS

| | | | | |
|---|---|---|---|---|
| 1807709 | | 6/1970 | (DE) . | |
| 3029991 | * | 3/1982 | (DE) | 164/401 |
| 0222732 | | 11/1985 | (EP) . | |
| 2447764 | | 8/1980 | (FR) . | |

* cited by examiner

*Primary Examiner*—Kuang Y. Lin
(74) *Attorney, Agent, or Firm*—Ostrolenk, Faber, Gerb & Soffen, LLP

(57) ABSTRACT

In a strand guide for a continuous casting plant comprising a plurality of strand supporting elements for supporting the strand, in particular support segments carrying supporting rollers, several support segments being fastened adjacent each other on a supporting framework designed in one piece in its longitudinal extension, each support segment is fastened to the supporting framework by a fixed bearing and a movable bearing spaced apart therefrom in the longitudinal extension of the strand guide, each support segment, by at least one bearing, is pivotally mounted to the supporting framework so as to be pivotable about an axis, the axis being oriented transversely with respect to the longitudinal extension of the strand guide and horizontally, as well as in a vertical plain passing through the longitudinal extension of the supporting framework and by at least one bearing is mounted so as to be adjustable with respect to the supporting framework in a direction toward the pivoting movement of the support segment. For simple adjustment of the correct position of the support segments, a measuring device for detecting the pivoting movement of the support segment, preferably a position sensor or an angle measuring device, is provided which, via a controller, is coupled with an adjusting device for adjusting the position of the support segment.

21 Claims, 6 Drawing Sheets

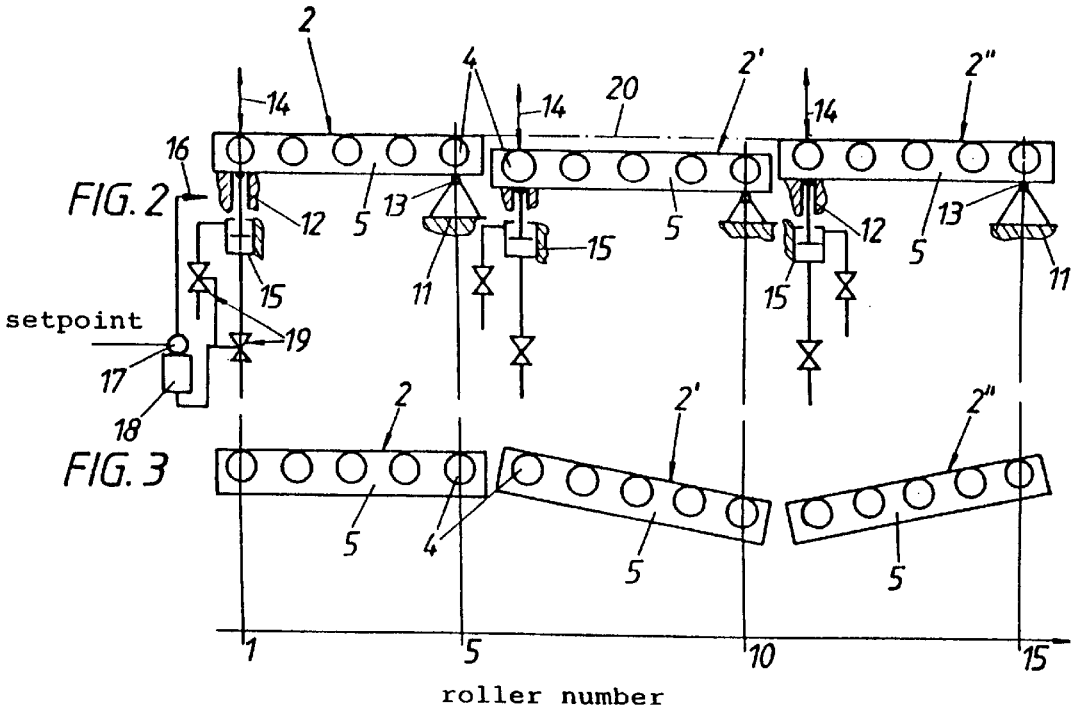
FIG. 4
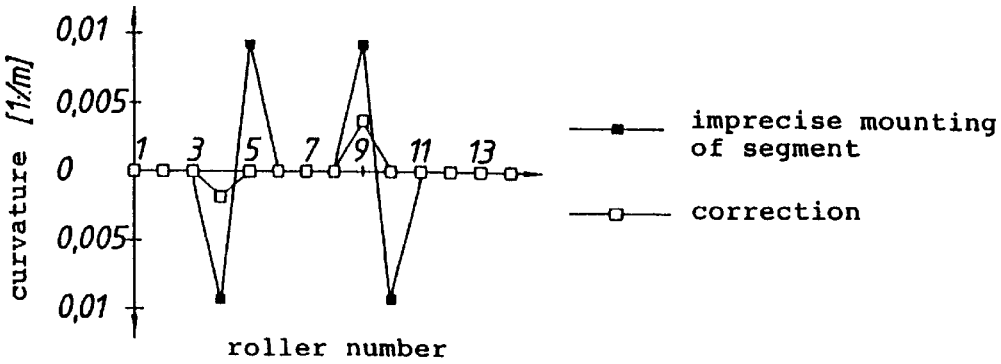

39
31A,B
30C
15
27
28
24
29

1
0
-1

15
29
31A,B
27
29
28
24
29
30C 1
0

BILLET-GUIDING SYSTEM FOR A CONTINUOUS CASTING PLANT

BACKGROUND OF THE INVENTION

The invention relates to a strand guide for a continuous casting plant, in particular for a continuous casting plant for steel, comprising a plurality of strand supporting elements for supporting the strand, in particular support segments carrying supporting rollers, several support segments being fastened adjacent each other on an optionally arcuate supporting framework designed in one piece in its longitudinal extension, wherein each support segment is fastened to the supporting framework by means of a fixed bearing and a movable bearing spaced apart therefrom in the longitudinal extension of the strand guide and each support segment by at least one bearing (fixed and/or movable bearing) is pivotally mounted to the supporting framework so as to be pivotable about an axis, said axis being oriented transversely with respect to the longitudinal extension of the strand guide and horizontally, as well as in a vertical plane passing through the longitudinal extension of the supporting framework and by at least one bearing (fixed and/or movable bearing) is mounted so as to be adjustable with respect to the supporting framework in a direction roughly perpendicular to the longitudinal extension of the supporting framework to enable the pivoting movement of the support segment, and a method of adjusting the position of support segments.

A strand guide of this kind is known e.g. from DE-A - 30 29 991. There, alignment of the support segments is feasible by displacing the support means at the bearings, namely through manipulations which have to be effected manually. However, this involves complications since it requires the plant to be out of operation and moreover can only be carried out in cooled-down condition. Hence, deformation caused by thermal expansion and influences occurring after start-up cannot be taken into account.

From EP-B - 0 222 732 a strand guide is known in which several support segments each carrying a plurality of strand guide rollers are arranged on a continuous longitudinal carrier designed in one piece, with the support segments being mounted on the longitudinal carriers via carrying brackets rigidly fastened to the longitudinal carriers by means of fitting pins, two neighboring support segments each being commonly mounted on the carrying brackets by means of carrying elements arranged on their ends. Each carrying bracket has a recess immovably receiving the carrying element of a support segment and a recess receiving the carrying element of the neighboring support segment with a play, thereby forming movable and fixed bearings. The play extends parallel to the path of the strand guide so that a thermal expansion of the support segments or of the longitudinal carrier will have no adverse effect on the accuracy of the strand guide.

From FR-A - 2 447 764 a strand guide is known in which strand guide the carrying brackets are pivotally fastened to the single-piece longitudinal carrier so that by pivoting the carrying brackets a support segment supported on the carrying bracket is lifted or lowered on the one hand and the neighboring support segment supported on the same carrying bracket is moved in a direction counter to the first one. In this way, the neighboring support segments can be aligned while avoiding a step-like transition in the path of the strand guide. One disadvantage involved here is that at least two neighboring support segments are pivoted in each instance if there is a height step at a site of transition from one support segment to the other support segment. This renders it difficult to keep to the path of the strand guide while maintaining the deviation from the ideal path of the strand guide as slight as possible, i.e. for instance to observe a circular-arc-shaped path of the strand guide, in the case of an arcuate strand guide. Major deviations of several support segments from the ideal position may occur since none of the support segments is fastened to the supporting framework by means of a fixed bearing.

The invention aims at avoiding these disadvantages and difficulties and has as its object to further develop a strand guide of the initially described kind in such a way as to ensure precise adjustment of the support segments during the entire operating time of the strand guide, requiring only short interruptions, if any, for adjusting the strand guide.

SUMMARY OF THE INVENTION

According to the invention, this object is achieved in that a measuring device for detecting the pivoting movement of the support segment, preferably a position sensor or an angle measuring device, is provided which via a controller is coupled with an adjusting device for adjusting the position of the support segment.

A particularly simple and robust construction of a strand guide is characterized in that vertically adjustable shims are provided for adjusting the position of the adjustable bearing.

For adjusting the adjustable bearing, there preferably is provided a threaded spindle, or according to another embodiment an axially displaceable wedge which is movable by means of a hydraulic adjusting cylinder, or according to yet another embodiment a hydraulic adjusting cylinder which acts between the supporting framework and the support segment.

A preferred embodiment is characterized in that for actuating the hydraulic adjusting cylinder there is provided at least one directional control valve which is capable of being switched via a three-level controller or a higher-level controller or a controller with a pulse-width output to which the actual value detected by the position sensor can be fed via a coupling.

The provision of a directional control valve enables a very simple control technique. A particularly high accuracy, which could be achieved e.g. by using the servo valve technology, is renounced here, yet in accordance with the invention there result the advantages of substantially reduced costs and a substantially reduced sensitivity to disturbances such as e.g. contamination of the oil or pressure drops or the like as compared to the servo valve technology. Surprisingly, the directional control valve technology has proved satisfactory for continuous casting operations even in the case of sensitive steel grades.

By employing a controller with a pulse-width output, nearly continuous control as it is typically achieved using servo or proportional valves can be achieved even with directional control valves. In the case of the on-off valve, the variable valve opening which is used with these continuously operating valves is replaced with a sequence of pulsed valve openings. This enables positioning operations to be carried out with high precision.

The servo valve technology enables very sensitive and rapid control of high outputs by means of small control inputs due to the supporting effect of the medium that flows through. The servo valve technology is mainly applied for difficult positioning tasks in machine tool technology. The demands both in terms of material and cost for realizing the servo valve technology are correspondingly high. Maintenance and measures for avoiding disturbing influences are likewise expensive.

Application of the servo valve technology in connection with continuous casting technology is known from U.S. Pat. No. 3,812,900; it allows adjusting the position of the movable strand guide roller with utmost precision. Disadvantages of this method are the great expenditures in terms of materials which are incurred in applying the servo valve technology as well as the great sensitivity to a contamination of the same; difficulties may result in heavy-duty iron- and steelworks operations.

Since according to the invention only minor volume flows are required for adjusting a support segment whereas the total system operates at high pressures (e.g. 160 bar), a throttle or screen suitably is integrated in at least one hydraulic working duct of the hydraulic adjusting cylinder leading from a pressure-medium supply station to the directional control valve or from this latter to the hydraulic adjusting cylinder.

A preferred embodiment is characterized in that a current control valve with rectification is integrated in at least one hydraulic working duct leading from a pressure-medium supply station to the directional control valve or from this latter to the hydraulic adjusting cylinder.

The provision of a current control valve leads to an adjusting velocity which is almost independent of the load and the corresponding hydraulic pressures. By tuning the design of the 3- or 5-level controller to this adjustment speed and the response and fall time of the respective directional control valve it becomes feasible to reach the desired setpoint for all types of loading in a very precise and direct manner.

Another preferred embodiment is characterized in that in the hydraulic working duct leading to and/or away from the hydraulic adjusting cylinder there is provided a throttle or screen connected immediately upstream respectively downstream of the hydraulic adjusting cylinder.

In order to achieve different adjustment speeds of the piston over the adjustment course of the hydraulic adjusting cylinder and hence an improved accuracy, an additional directional control valve preferably is provided connected in parallel with a throttle or screen or with the current control valve with rectification, wherein a five-level controller or a higher-level controller is suitably provided as a controller.

The invention further relates to a strand guide which is characterized in that the position sensor is formed by a balancing cylinder connected in parallel with the hydraulic adjusting cylinder and acting diametrically opposed to the hydraulic adjusting cylinder and which on the one hand is connected with the supporting framework and on the other hand with a support segment.

A method of adjusting and/or correcting the position of support segments fastened successively in a supporting framework and provided with strand supporting elements, in particular supporting rollers, with each support segment being fastened to the supporting framework by means of a fixed bearing and a movable bearing spaced apart therefrom in the longitudinal extension of the strand guide, is characterized in that of neighboring support segments whose strand supporting elements result in a path of the strand guide exhibiting a jump at the junction point of the support segments, the support segment adjoining the neighboring support segment by its adjustable bearing is pivoted about its bearing permitting a pivoting movement, namely is pivoted until the jump has been minimized.

In this method, preferably the support segment is pivoted until a tangent circle laid to three neighboring strand supporting elements of which one strand supporting element belongs to one support segment and two strand supporting elements to the neighboring support segment exhibits a radius or a curvature whose deviation from the desired (ideal) radius or from the associated curvature becomes a minimum.

BRIEF DESCRIPTION OF THE DRAWINGS

FIGS. 2 and 3 are schematic sketches explaining the invention.

FIG. 4 illustrates the change in the curvature at the transition from the imprecise mounting of the segments by the correction to be carried out according to the invention.

DESCRIPTION OF PREFERRED EMBODIMENTS

Figure 1:
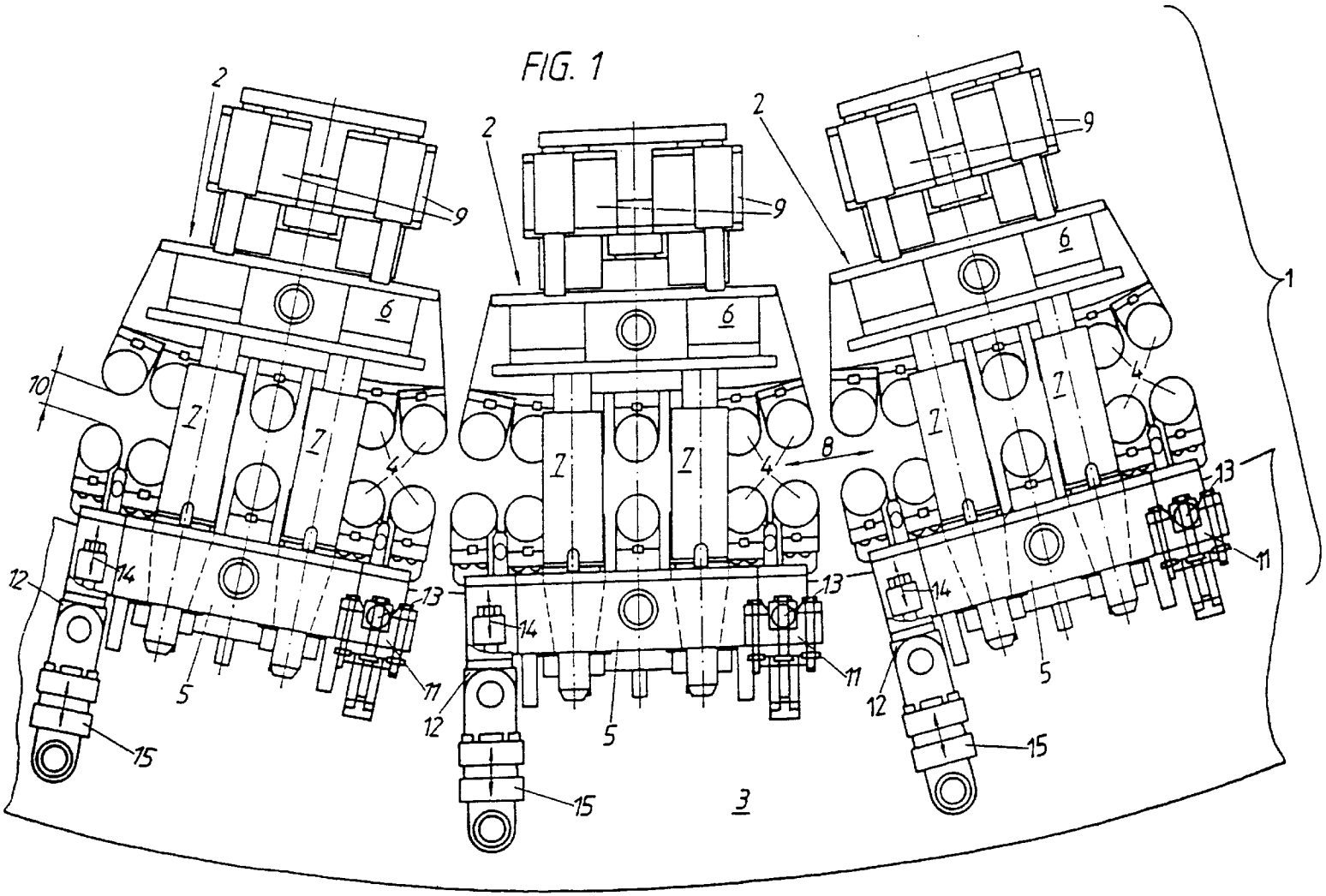
FIG. 1 is a partial lateral view of a strand guide of a of a continuous casting plant.

A strand guide 1 of an arcuate continuous casting plant is provided with one-piece longitudinal carriers of arcuate design for receiving several support segments 2, which carriers serve as a supporting framework 3 for the support segments 2 and are each supported on the foundation by means of bearings (not illustrated).

According to the overall length of the strand guide 1, two or several longitudinal carriers 3 are provided successively in the longitudinal direction of the strand guide, with each longitudinal carrier 3 carrying two or several support segments 2 in each case, strand supporting elements 4, in particular supporting rollers, being arranged on the support segments. If two or several longitudinal carriers 3 are arranged successively, one of the segments may be provided in order to bridge the longitudinal carriers 3, i.e. it may be mounted both on the first longitudinal carrier 3 and on the subsequent longitudinal carrier 3.

Following the arcuate longitudinal carrier 3, the strand guide 1 extends at least over the length throughout which the strand has a liquid core, so that, generally, longitudinal carriers 3 may also be arranged in the same manner in the horizontal portion of the strand guide 1 located after the arcuate portion of the strand guide 1 and each of them will likewise carry two or several support segments 2. Instead of the longitudinal carrier 3 there may also be provided cast concrete foundations or a single concrete foundation, on which the support segments 2 are mounted. Where a concrete foundation serves as the supporting framework 3, the support segments 2 are suitably arranged on steel plates fastened to said concrete foundation, with preferably no more than two to four bearings being provided on said steel plates.

Each support segment 2 is formed by lower roll supports 5 and upper roll supports 6 connected with each other by means of tension rods 7. The tension rods extend roughly perpendicular with respect to the longitudinal extension 8 of the strand guide 1 and hence also with respect to the supporting framework 3 so that in the case of an arcuate strand guide 1 they are directed roughly towards the center of curvature. At the upper ends of the tension rods 7, i.e. on their ends located inside the arc, hydraulic adjusting cylinders 9 are provided by means of which it is feasible to alter the roller gap 10 of the rollers 4 facing each other, which are rotatably fastened to the roll supports 5 and 6. To accomplish this, the upper roll support 6 is moved relative to the lower roll support 5 along the tension rods 7 by a predetermined measure and is positioned after reaching the desired position.

Each of the support segments 2 by the lower roll support 5 is fastened to the longitudinal carrier 3 at one end by means of a fixed bearing 11 and at the opposing end by means of a movable bearing 12, with one fixed bearing 11 each of a support segment 2 being arranged subsequent to a movable bearing 12 of the neighboring support segment 2, resulting in an alternate arrangement of movable and fixed bearings. The fixed bearings 11 are designed such that the support segments 2 are capable of being pivoted about a horizontal axis 13 extending parallel with respect to the supporting rollers 4 and passing through the fixed bearings 11, namely are pivotable in a plane that is parallel to the vertical plane (=the plane of projection of FIGS. 1 to 3) extending in the longitudinal extension of the strand guide.

The movable bearings 12 enable this pivoting movement in that each lower roll support 5 of the support segments 2 is movable about the pivot axis 13 of the fixed bearing 11 in a direction 14 roughly perpendicular with respect to the longitudinal extension 8 of the strand guide 1 and in a plane that passes through the longitudinal extension 8 of the strand guide 1 in vertical direction. This movability can be realized either by means of threaded spindles or through hydraulic adjusting cylinders 15 acting e.g. directly on the lower roll support 5 or on a wedge that is slideably guided in the movable bearing 12. Vertically adjustable shims may serve for adjusting and securing the position of a support segment. To ensure a precise extent of the adjusting movement, a position sensor 16 is preferably integrated in the movable bearing 12. The actual value of the position of the support segment 2 detected by the position sensor 16 is passed on to a comparator 17 of a controller 18, is there compared with the setpoint, and the hydraulic adjusting cylinder 15 is actuated via a valve 19 as a function of this comparison.

To enable the strand guide 1 to be readjusted after coarsely mounting the support segments 1 on the longitudinal carriers 3, i.e. to avoid jumps between the successively arranged support segments 2—these would deform the strand which still has a thin strand shell in an unacceptable manner and could cause a breakthrough of the strand—the following procedure is employed:

First of all, a casting gap gauge, by which both the casting gap and its local curvature can be measured, is moved through the strand guide 1 in order to detect the actual position of the support rollers 4 and the support segments 2. The arrangement of the supporting rollers 4 within each support segment 2 can be accurately adjusted with great precision in a machine shop, such that mis-positioning need not be anticipated in this respect. After carrying out the measurements with the casting gap gauge (such a device is described e.g. in AT-B - 393.739), the measuring report is evaluated and the necessary corrective movements of the individual support segments 2 that are still to be carried out are calculated. This can be done with the aid of a computer.

If e.g. a position of three support segments 2, 2', 2" arranged one behind the other is known from the measuring report, as is shown in FIG. 2—although for reasons of simplicity only for the lower roll support 5—it can be seen that the middle support segment 2' deviates from the ideal path of the strand guide, which is illustrated by a dashed and dotted line 20. According to the example, it is located about 1 mm too low. In this example, a roll diameter of 300 mm and a roller pitch of 330 mm are realized. According to the invention, correction of the position of the support segments 2, 2', 2" is carried out in that the second support segment 2' on the end on which it has the movable bearing 12 is lifted to such an extent that a minimal curvature of the strand guide 1 results between the neighboring supporting rollers 4 of the neighboring support segments 2, 2'. In the same manner, the third support segment 2" is lowered at the site where it is fastened to the longitudinal carriers 3 by means of a movable bearing 12, likewise until the local curvature between the neighboring supporting rollers 4 of the neighboring support segments 2 and 2' is a minimum.

To calculate the curvature, a tangent circle is laid to three successive supporting rollers 4 of which one belongs to the one and two belong to the other neighboring support segment 2, and the radius and curvature of this circle are calculated. In FIG. 4, the local curvature above the respective middle supporting roller of the three selected supporting rollers 4 of neighboring support segments 2, 2', 2" has been illustrated. A solid black square has been used to indicate the values resulting in the case of imprecise mounting of the segments as described above. An empty square has been used to illustrate the curvature values after correction. In the example, the maximal curvature is thus reduced to about a third of the original value as a result of the correction. The curvature in conjunction with the shell thickness of the strand can be interpreted as a measure of the expansions occurring in the two-phase layer (between the solidified shell of the strand and the liquid core) and hence as a criterion of quality.

Figure 6:
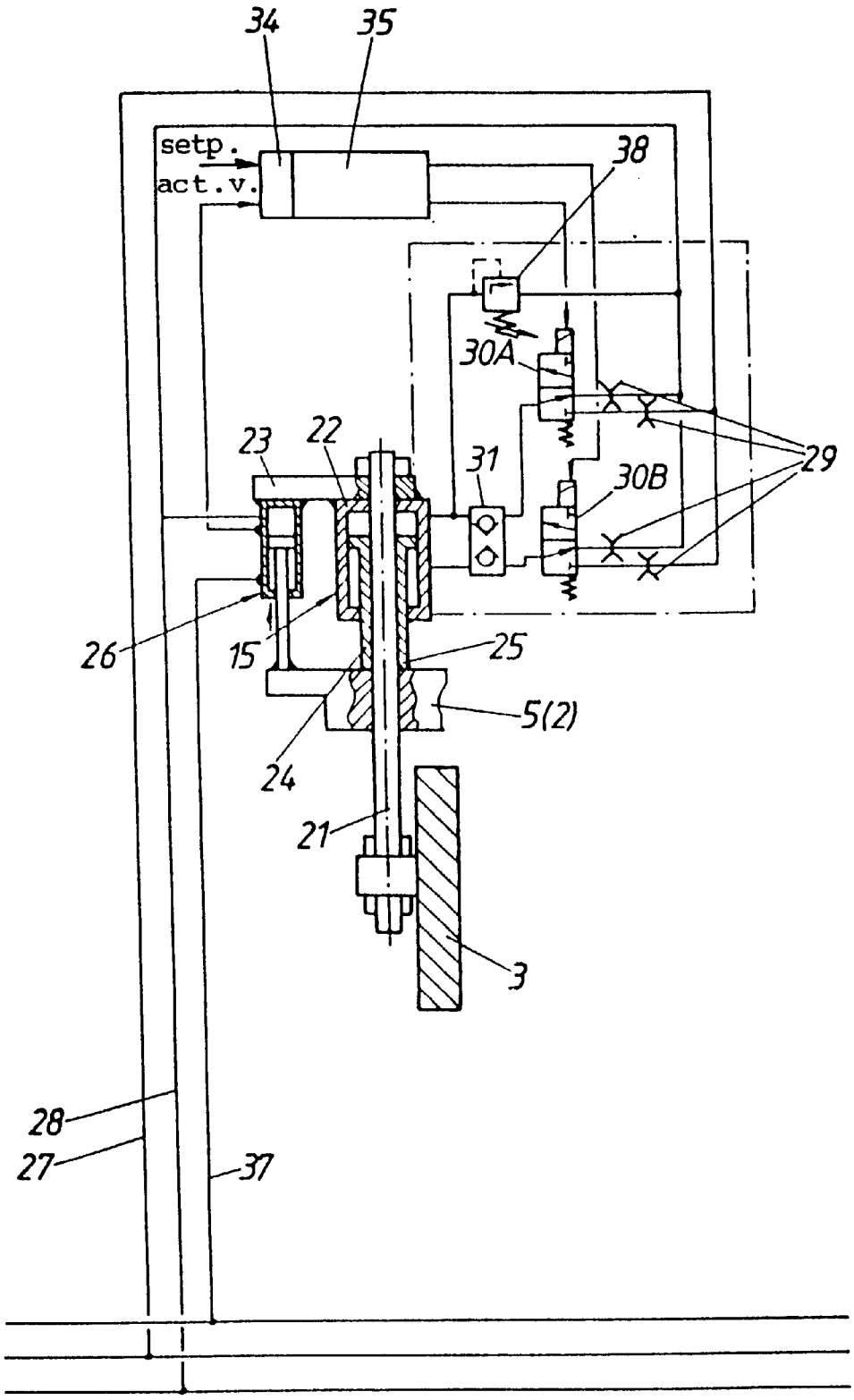
FIG. 6 illustrates the arrangement thereof on a strand guide, also in schematic representation.

According to the embodiment of a movable bearing 12 represented in FIG. 6, a tension rod 21 is wedged to the supporting framework 3, i.e. at a longitudinal carrier, and is connected with the lower roll support 5. The roll support 5 is displaceable along the tension rod 21, so that the support segment 2 is pivotable about the fixed bearing 11. A hydraulic adjusting cylinder 15 serves for realizing a movement of the roll support 5 relative to the supporting framework 3.

The cylinder 22 of the hydraulic adjusting cylinder 15 is supported on an additional carrier 23 likewise wedged with respect to the tension rod 21, so that the additional carrier 23 is fixed in its position relative to the supporting framework 3. For equal and radially symmetrical force introduction, the piston 24 of the hydraulic adjusting cylinder 15 is preferably constructed as a tubular piston passed through by the tension rod 21. The front end 25 of the piston 24 is supported on the roll support 5.

Between the additional carrier 23 and the roll support 5 a balancing cylinder 26 is provided which is arranged in parallel to the hydraulic adjusting cylinder 15 and is at all times actuated in such a way that the roll support 5 rests against the front end 25 of the piston 24 of the hydraulic adjusting cylinder 15, i.e. is pressed against the same. The cylinder of the balancing cylinder 26 is connected with the additional carrier 23, and the piston with the roll support 5. This balancing cylinder could also be arranged between the additional carrier 23 and the roll support 5 in a position rotated through 180°. The balancing cylinder 26 enables the roll support 5 to be positioned without play in relation to the supporting framework 3 and in addition serves e.g. as a position sensor for detecting the actual position of the roll support 5, as is shown schematically in FIG. 5. In this manner, crushing or contamination of the site of application of the force of the hydraulic adjusting cylinder 15 on the roll support 5—hence on the bearing site of the piston 24—exert no negative influence on the set-point to which the support segment 2 is to be adjusted.

Figure 5:
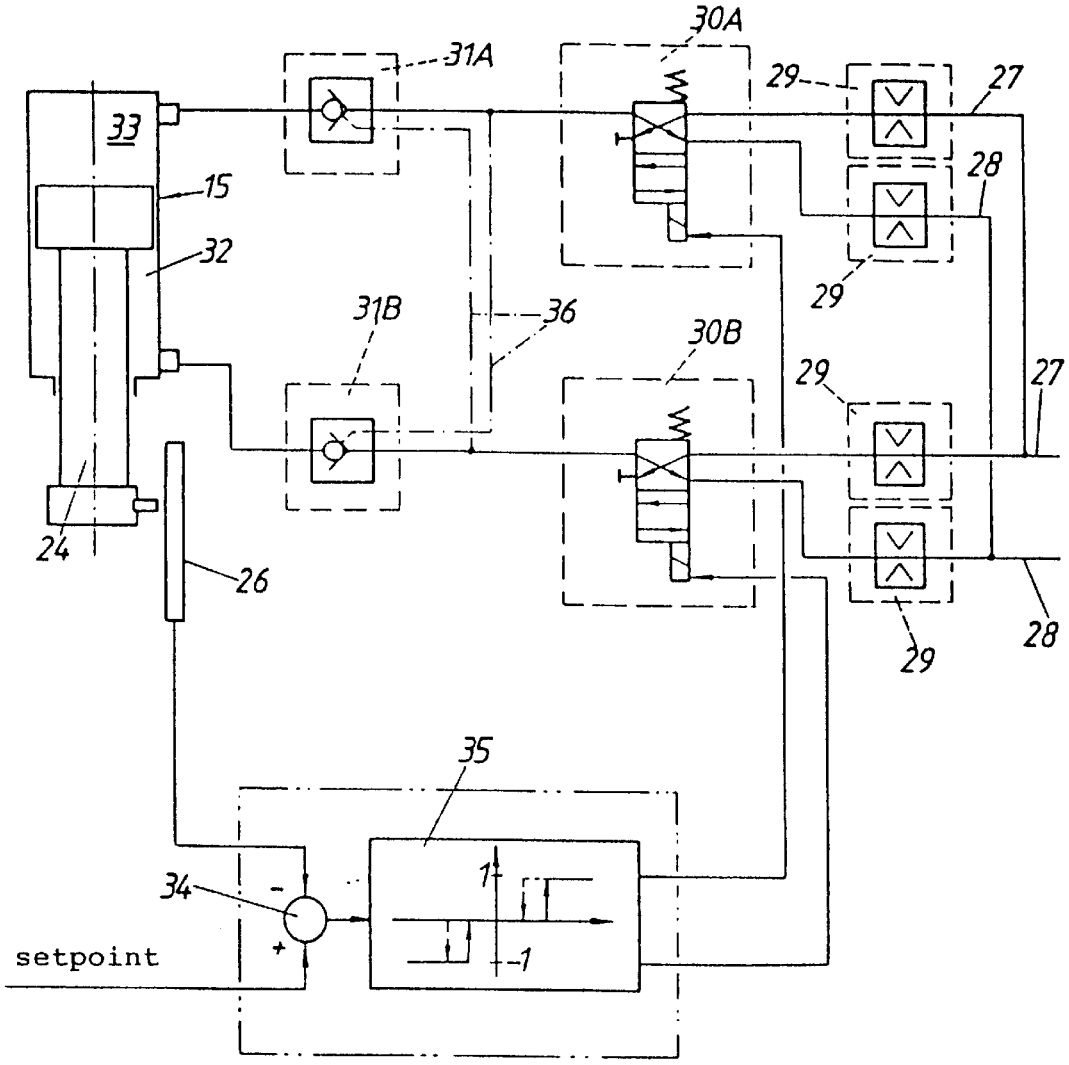
FIG. 5 illustrates a preferred controlling scheme according to the invention for the hydraulic adjusting cylinder in schematic representation.

As can be seen particularly from FIG. 5, hydraulic working ducts 27, 28 can each be connected with a respective chamber 32, 33 of the hydraulic adjusting cylinder 15 via throttles 29 or screens and directional control valves 30A, 30B and controlled nonreturn valves 31A, 31B provided downstream of the same. The respective position of the piston 24 of the hydraulic adjusting cylinder 15—and hence of the support segment 2—is detected via the position sensor, i.e. the balancing cylinder 26, and its signal is then passed on to a comparator 34 of a three-level controller 35. The set-point setting for the position of the piston 24 of the hydraulic adjusting cylinder 15 can be fed into the comparator 34. If the actual value deviates from the set-point, the three-level controller 35 becomes active, with the valve 30A switching at the signal +1 and the valve 30B at the signal −1.

The nonreturn valves 31A and 31B located in the hydraulic working ducts 27, 28 leading to the two chambers 32 and 33 of the hydraulic adjusting cylinder 15 are each acted upon via the control ducts 36 by the hydraulic working duct 27, 28 leading into the respective other chamber.

According to the embodiment illustrated in FIG. 6, the balancing cylinder 26 is adapted to be pressurized by a separate hydraulic working duct 37. Further, there is provided a pressure control valve 38, limiting the force of the piston 24 of the hydraulic adjusting cylinder 15.

Figure 7:
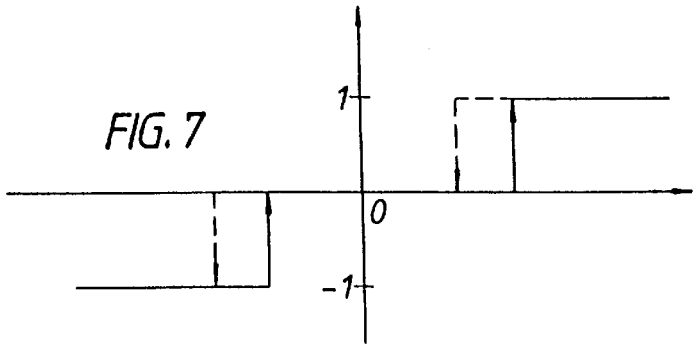
FIGS. 7 and 8 show the functioning of a three-level controller and a five-level controller in dependence on the deviation.

In FIG. 7, the control of the three-level controller 35 is explained in more detail, with the selection of the directional control valves being plotted on the ordinate and the deviation on the abscissa. If the three-level controller 35 gives the signal +1, the magnet of the directional control valve 30A is switched, whereas the magnet of the directional control valve 30B is without current. If the signal of the three-level controller 35 is 0, both magnets of the directional control valves 30A and 30B are without current; at the signal −1, the magnet of the directional control valve 30A is without current and the magnet of the directional control valve 30B switches.

Figure 9:
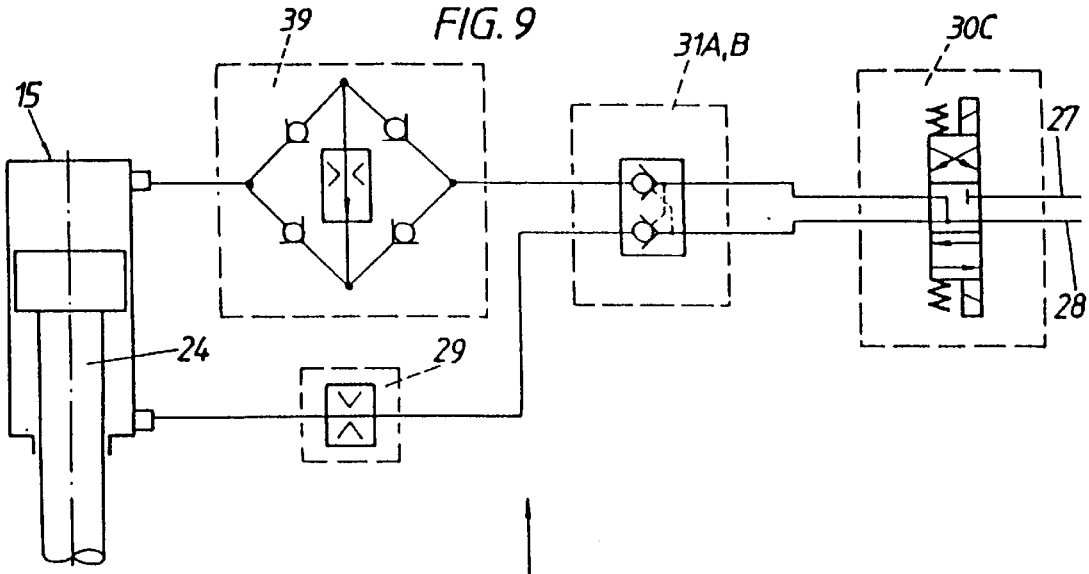
FIG. 9 illustrates a basic circuitry comprising a current control valve.
Figure 10:
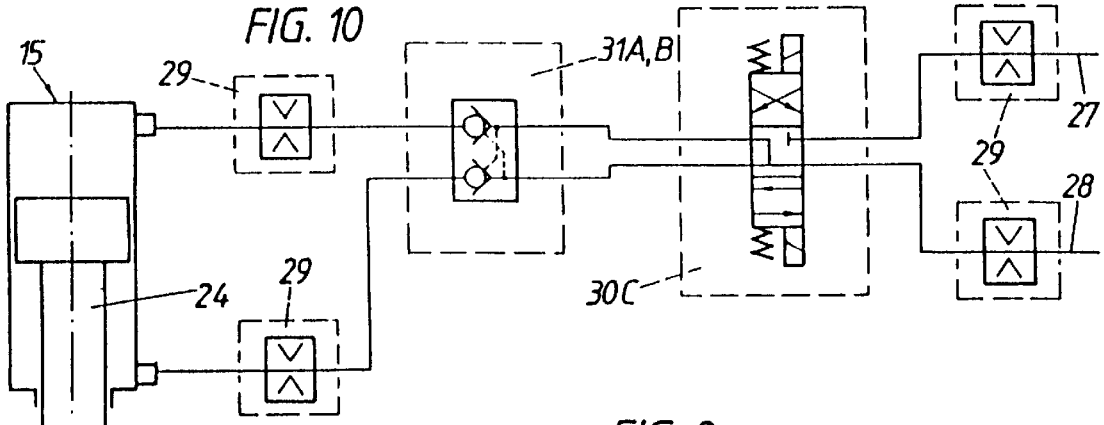
FIG. 10 illustrates the basic circuitry comprising a 4/3-port directional control valve with screens.

FIG. 9 shows a slightly modified circuitry comprising a 4/3-port directional control valve 30C and provided with a current control valve 39 with rectification. FIG. 10 shows a similar circuitry likewise comprising a 4/3-port directional control valve 30C, yet without a current control valve. According to this embodiment, throttles 29 or screens are arranged in the hydraulic working ducts 27, 28 between the nonreturn valves 31A, 31B and the hydraulic adjusting cylinder 15, in addition to throttles 29 or screens provided in front of the 4/3-port directional control valve 30C. In this way, a great possibility of variation with respect to the speed of the hydraulic adjusting cylinders 15 can be achieved. The throttles or screens can be dimensioned the larger the more there are provided of them, which has the advantage that the throttles 29 or screens are considerably less sensitive to contamination.

By omitting the throttles 29 or screens provided before the 4/3-port directional control valve 30C in the embodiment illustrated in FIG. 6 or dimensioning them larger than the throttles 29 or screens arranged immediately in front of the hydraulic adjusting cylinder 15, the main throttling effect (or main screening effect) can be achieved between the nonreturn valves 31A and 31B and the hydraulic adjusting cylinder 12, whereby the switching times of the nonreturn valves 31A and 31B may be kept particularly short. In addition, oscillations of the nonreturn valves 31A and 31B are avoided by this measure. Basically, the arrangement of throttles 29 or screens in the immediate vicinity of the hydraulic adjusting cylinder 15, i.e. between the nonreturn valves 31A and 31B and the hydraulic adjusting cylinder 15 can also be realized in all of the other embodiments shown in FIGS. 1, 2, 5 and 7, such that the advantages that have been described above will also result with these embodiments.

Figure 8:
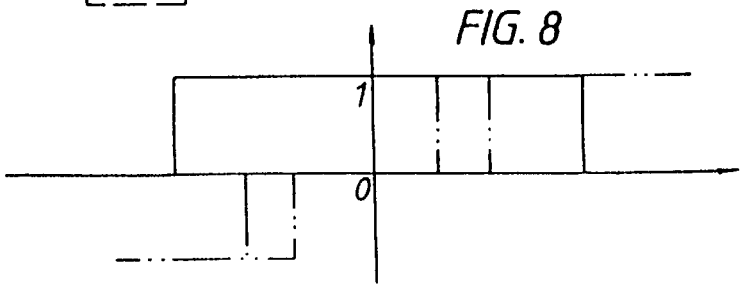
Figure 11:
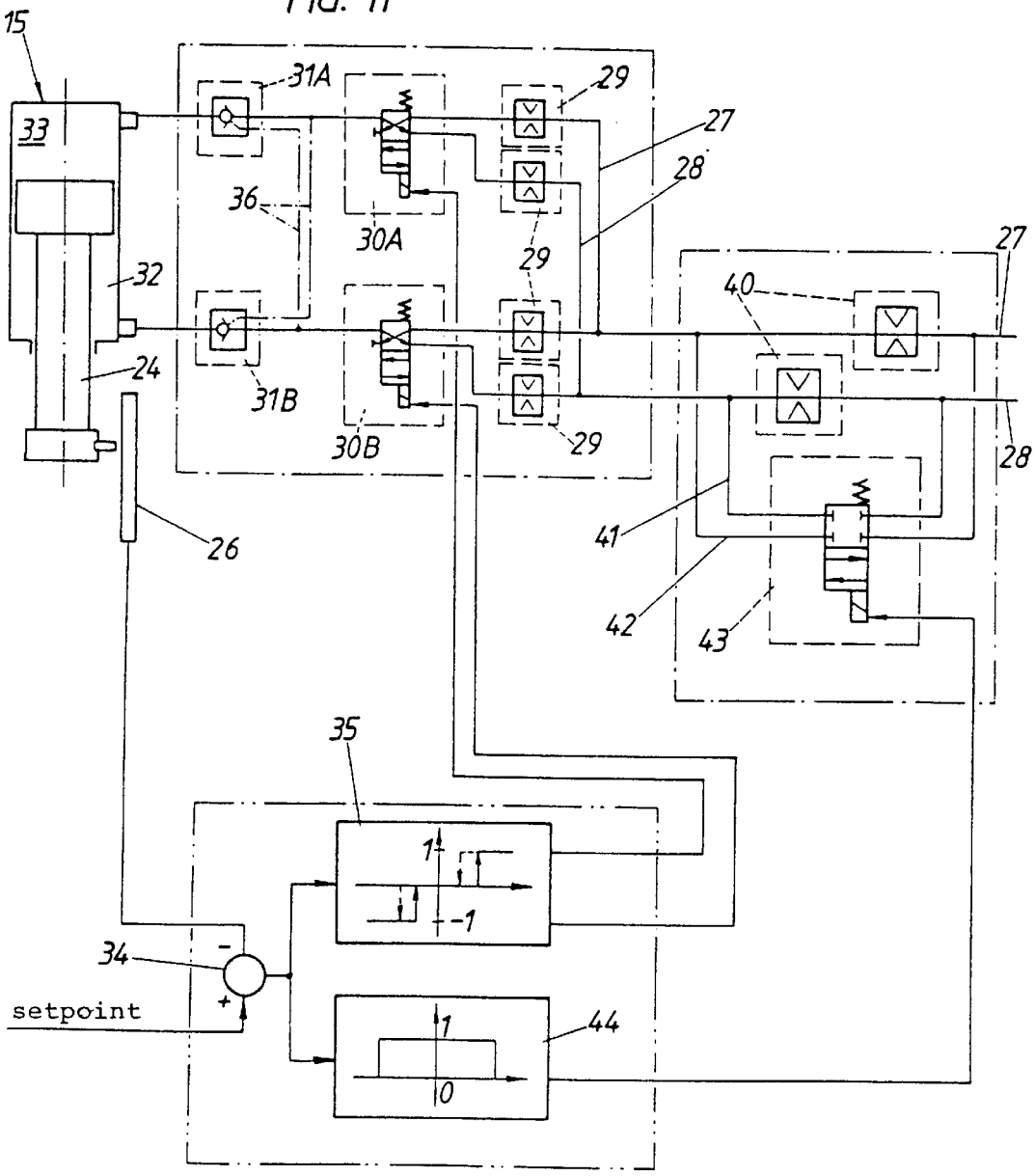
FIG. 11 shows a valve-throttle combination for realizing two adjustment speeds of the piston of a hydraulic adjusting cylinder.

In FIG. 11 there is illustrated a valve-throttle combination for realizing two adjusting velocities of the hydraulic adjusting cylinder 15. The piston 24 of the hydraulic adjusting cylinder 15 can be moved at rapid speed or at creep speed. In this circuitry in which the part surrounded by dashed and dotted lines is identical with the circuitry according to FIG. 5, throttles 40 or screens, each of which can be bridged by a bypass 41, 42, are additionally connected preceding the directional control valves 30A and 30B in the hydraulic working ducts 27, 28. Bridging can be achieved by means of a directional control valve 43 which is provided in the bypass ducts 41, 42 and which can be activated or deactivated via a five-level controller. The five-level control is realized by means of a three-level controller 35 according to FIG. 5 having a mode of operation in accordance with FIG. 7 and a rapid speed/creep speed switch 44 whose mode of operation is explained in FIG. 8. As the piston 24 of the hydraulic adjusting cylinder 15 approaches the switching zone of the three-level controller 35, a lower speed is switched via the rapid speed/creep speed switch 44, namely by means of one of the interconnectable screens 40, so that a more accurate positioning can be achieved. By the signal +1, the rapid speed/creep speed switch 44 moves the directional control valve 43 into the position for the creep speed, which is shown in FIG. 8, and by the signal 0 it moves the directional control valve 43 into the rapid speed position in which the hydraulic medium flows via the by-pass ducts 41 and 42.

Instead of the three-level controller 35 it is also possible to provide a controller with a pulse-width output.

What is claimed is:

1. Strand guide (1) for a continuous casting plant, comprising a plurality of strand supporting elements (4) for supporting the strand, several support segments being fastened adjacent each other on a supporting framework (3) designed in one piece in its longitudinal extension, wherein each support segment (2) is fastened to the supporting framework (3) by means of a fixed bearing (11) and movable bearing (12) spaced apart therefrom in the longitudinal extension of the strand guide and each support segment (2) by at least one bearing is pivotally mounted to the supporting framework (3) so as to be pivotable about an axis (13), said axis being oriented transversely with respect to the longitudinal extension (8) of the strand guide (1) and horizontally, as well as in a vertical plane passing through the longitudinal extension (8) of the supporting framework (3) to at least one bearing (11, 12)) is mounted so as to be adjustable with respect to the supporting framework (3) in a direction roughly perpendicular to the longitudinal extension (8) of the supporting framework (3) to enable the pivoting movement of the support segment (2), characterized in that a measuring device for detecting the pivoting movement of the support segment (2) is provided which via a controller (18) is coupled with an adjusting device (15) for adjusting the position of the support segment (2).

2. Strand guide according to claim 1, wherein vertically adjustable shims are provided for adjusting the position of the support segments (2).

3. Strand guide according to claim 1, characterized in that a threaded spindle is provided for adjusting the adjustable bearing (12).

4. Strand guide according to claim 1, characterized in that for adjusting the adjustable bearing (12) an axially displaceable wedge is provided which is movable by means of a hydraulic adjusting cylinder.

5. Strand guide according to claim 1, characterized in that for adjusting the adjustable bearing (12) there is provided a hydraulic adjusting cylinder (15) which acts between the supporting framework (3) and the support segment (2).

6. Strand guide according to claim 1, wherein, as means for actuating the hydraulic adjusting cylinder, at least one directional control valve is provided which is capable of being switched via a controller having at least three levels to which the actual value detected by the position sensor can be fed via a coupling.

7. Adjusting device according to claim 6, characterized in that a throttle (29) or screen is integrated in at least one hydraulic working duct (27, 28) of the hydraulic adjusting cylinder (15) leading from a pressure-medium supply station to the directional control valve (30A, 30B, 30C) and from this latter to the hydraulic adjusting cylinder (15).

8. Adjusting device according to claim 6, characterized in that a current control valve (39) with rectification is integrated in at least one hydraulic working duct (27, 28) leading from a pressure-medium supply station to the directional control valve (30A, 30B, 30C) and this latter to the hydraulic adjusting cylinder (15).

9. Strand guide according to claim 6, wherein in the hydraulic working duct (27, 28) leading to the hydraulic adjusting cylinder (15) there is provided a throttle (29) connected immediately upstream of the hydraulic adjusting cylinder (15).

10. Strand guide according to claim 6, wherein an additional directional control valve (43) is provided connected in parallel with a throttle with rectification.

11. Strand guide according to claim 10, wherein a controller (35, 44) having at least five levels is provided as a controller.

12. Strand guide according to claim 6, characterized in that the position sensor (26) is formed by a balancing cylinder (26) connected in parallel with the hydraulic adjusting cylinder (15) and acting diametrically opposed to the hydraulic adjusting cylinder (15) and which on the one hand is connected with the supporting framework (3) and on the other hand with a support segment.

13. A strand guide according to claim 1, wherein said strand supporting elements (4) are support segments (2) carrying supporting rollers (4).

14. A strand guide according to claim 1, wherein said measuring device for detecting the pivoting move of the supporting segment (2) is a position sensor.

15. A strand guide according to claim 1, wherein said measuring device for detecting the pivoting movement of the support segment (2) is an angle measuring device.

16. A strand guide according to claim 1, wherein, as means for actuating the hydraulic adjusting cylinder, at least one directional control valve is provided which is capable of being switched via a controller with a pulse-width output to which the actual valve detected by the position sensor can be fed via a coupling.

17. A strand guide according to claim 6, wherein in the hydraulic working duct (27, 28) leading away from the hydraulic adjusting cylinder (15) there is provided a screen connected downstream of the hydraulic adjusting cylinder (15).

18. A strand guide according to claim 6, wherein an additional directional control valve (43) is provided connected in parallel with a sensor with rectification.

19. A strand guide according to claim 6, wherein an additional direction control valve (42) is provided connected in parallel with said current control valve with rectification.

20. Strand guide according to claim 1, wherein said supporting framework is arcuate.

21. Method of adjusting the position of support segments (2) fastened successively in a supporting framework (3) and provided with strand supporting elements (4) with each support segment (2) being fastened to the supporting framework (3) by means of a fixed bearing (11) and a movable bearing (12) spaced apart therefrom in the longitudinal extension (8) of the strand guide (1), said method being by detecting and controlling the pivoting movement of the support segment, and comprising the step of pivoting, about its fixed bearing (11), the support segment adjoining the support segment of neighboring support segments (2) whose strand supporting elements (4) result in a path of the strand guide exhibiting a jump at the junction point of the support segments (2), until a tangent circle laid to three neighboring strand supporting elements (4) of which one strand supporting element (4) belongs to one support segment and two supporting elements (4) to the neighboring support segment (2) exhibits a radius or a curvature whose deviation from the desired (ideal) radius or from the associated curvature becomes a minimum.

* * * * *